US005901921A

United States Patent [19]

Perlsweig

[11] Patent Number: 5,901,921

[45] Date of Patent: May 11, 1999

[54] TOILET TISSUE ROLL HOLDER

[76] Inventor: Leon Perlsweig, 6300 Wilshire Blvd. Stuite 1630, Los Angeles, Calif. 90048

[21] Appl. No.: 09/042,131

[22] Filed: Mar. 13, 1998

[51] Int. Cl.[6] ..... B65H 16/04

[52] U.S. Cl. ..... 242/597; 242/598.1; 242/598.6

[58] Field of Search ..... 242/597, 597.1, 242/597.2, 597.3, 597.4, 597.5, 597.6, 597.7, 597.8, 598, 598.1, 598.2, 598.3, 598.4, 598.5, 598.6; 312/34.8, 34.24

[56] References Cited

U.S. PATENT DOCUMENTS

| | | | |
|---|---|---|---|
| 1,153,389 | 9/1915 | Hudgel | 242/598.4 |
| 1,156,266 | 10/1915 | Bens et al. | 242/598.2 |
| 1,664,278 | 3/1928 | Zido | 242/598.4 |
| 1,889,024 | 11/1932 | Marsh | 242/598.1 |
| 2,486,607 | 11/1949 | Laystrom et al. | 242/598.3 |
| 3,304,034 | 2/1967 | Jones | 242/598.4 |
| 3,482,794 | 12/1969 | Beardsley . | |
| 3,703,996 | 11/1972 | Ulseth . | |
| 4,089,481 | 5/1978 | Ciuci . | |
| 4,205,802 | 6/1980 | Economakis . | |
| 4,273,299 | 6/1981 | Ness . | |
| 4,416,425 | 11/1983 | Kish | 242/598.1 |

FOREIGN PATENT DOCUMENTS

| | | | |
|---|---|---|---|
| 2 135 466 | 2/1973 | Germany | 242/598.1 |
| 1 549 604 | 8/1979 | United Kingdom | 242/598.3 |

*Primary Examiner*—John P. Darling
*Attorney, Agent, or Firm*—Baker & Botts, L.L.P.

[57] ABSTRACT

A toilet tissue roll holder has a flanged, generally semi-cylindrical housing and a spindle fixed at one end to a member slideable along one side of the housing. To replace a roll of toilet tissue, the spindle is pulled forward with the slideable member leaving the free end of the spindle exposed for insertion of the tissue roll. The spindle with the new roll is then pushed back into the housing. A detent engages the free end of the spindle to secure the spindle within the housing during normal use.

8 Claims, 3 Drawing Sheets

TOILET TISSUE ROLL HOLDER

SPECIFICATION

This invention relates to holders for toilet tissue rolls and the like, and more particularly to such a holder by means of which changing of tissue rolls is facilitated.

BACKGROUND OF THE INVENTION

Conventional toilet tissue roll holders, and especially the type that are partially recessed in the wall, present annoying difficulties when installing a new roll of tissue. Typically, these holders employ spring-loaded spindles having protrusions at both ends for engaging recesses in the side walls of the housing of the holder. The difficulty arises in compressing the spindle while it is within a new tissue roll and positioning it so that the protrusions engage the recesses in the housing when the spindle is released. The small clearances between the tissue roll on the housing oftentimes causes a miss when the spindle is released, with the roll and the spindle springing outward and falling. In the case of spindles formed of hollow telescoping tubes with an inner spring, the problem is increased because on release, the spindle disassembles with spring force into its component parts and must be retrieved.

These difficulties are particularly troublesome to small children or adults with impaired manual dexterity or vision problems.

It is the object of the present invention to provide a toilet tissue roll holder that avoids the problems presented by conventional holders and enables rapid and easy replacement of tissue rolls or rolls of other types of sheet material without the necessity for a separable spring loaded spindle.

It is a further object of the invention to provide such a holder that is simple and inexpensive to manufacture and can readily replace existing tissue holders.

SUMMARY OF THE INVENTION

In accordance with the invention, the holder includes a housing, generally semi-cylindrical in shape for partially receiving a tissue roll and a slidable member carrying a spindle. The slidable member is mounted on the side of the housing and carries the spindle at its forward end. The spindle is fixed at one end to the slidable member with its other end free and is oriented parallel to the axis of the semi-cylindrical housing. When the spindle and slidable member are pulled forward, the spindle is drawn clear of the housing a distance sufficient to permit a tissue roll to be slipped over the free end in a simple movement. The roll is then pushed inwardly towards the interior of the housing, returning the spindle and the slidable member to their rearward positions and presenting the tissue roll in its proper position for use. A releasable detent retains the spindle and the tissue roll in proper position within the housing during normal use.

The housing may be similar in general shape to those of commercially available fixtures and in the case of recessed fixtures, may be mounted in an appropriately sized opening in a wall by means of clamps, adhesives, etc. Accordingly, the holder is suitable for replacement of existing fixtures as well as for new installations.

BRIEF DESCRIPTION OF THE DRAWINGS

The invention will be more fully understood and appreciated from the following detailed description thereof, when taken in conjunction with the appended drawings, in which.

DETAILED DESCRIPTION OF THE INVENTION

Figure 1:
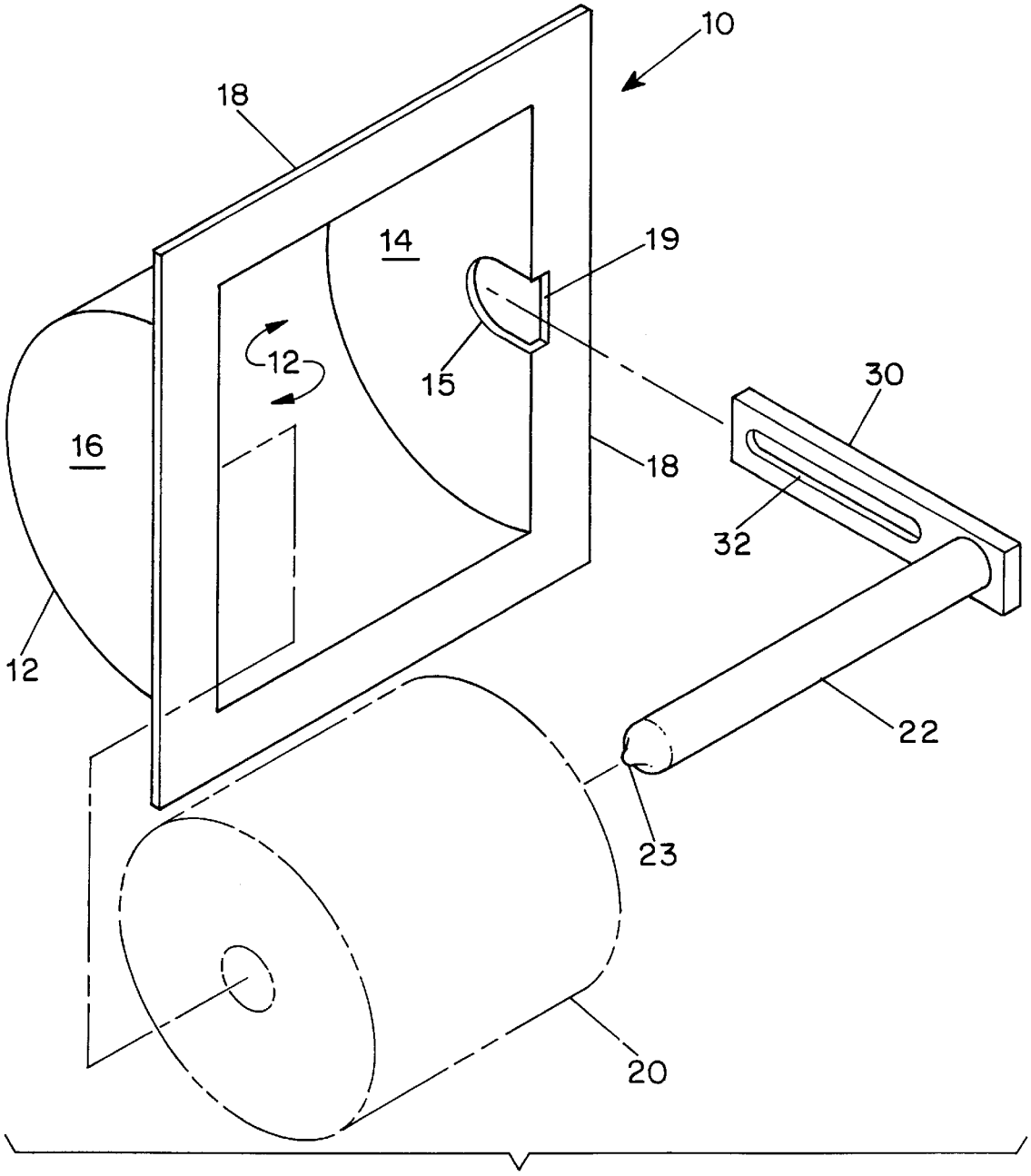
FIG. 1 is an exploded perspective view of a holder in accordance with the invention viewed from the left.

Referring to FIG. 1, a housing 10 comprises a generally semi-cylindrical rear wall 12 and planar sidewalls 14, 16, surrounded by a flange 18. The rearwall 12 is dimensioned to partially receive a regular roll of toilet tissue, shown in dotted line at 20, with sufficient clearance to permit the roll to rotate freely on its spindle 22 when it is in its normal position for use. As will be apparent from the ensuing description, the depth of the recap wall chosen 12 so that the spindle 22 is inside of the flange 18 when in normal position for use.

The right sidewall 14 and flange 18 have cut-outs 15 and 19 to receive spindle 22 and slidable member 30, respectively, when mounted on the housing and in retracted position, as will be explained more fully hereinafter. Preferably, the interior end of the cut-out 15 is arcuate in shape to conform to the curvature of the spindle.

Figure 3:
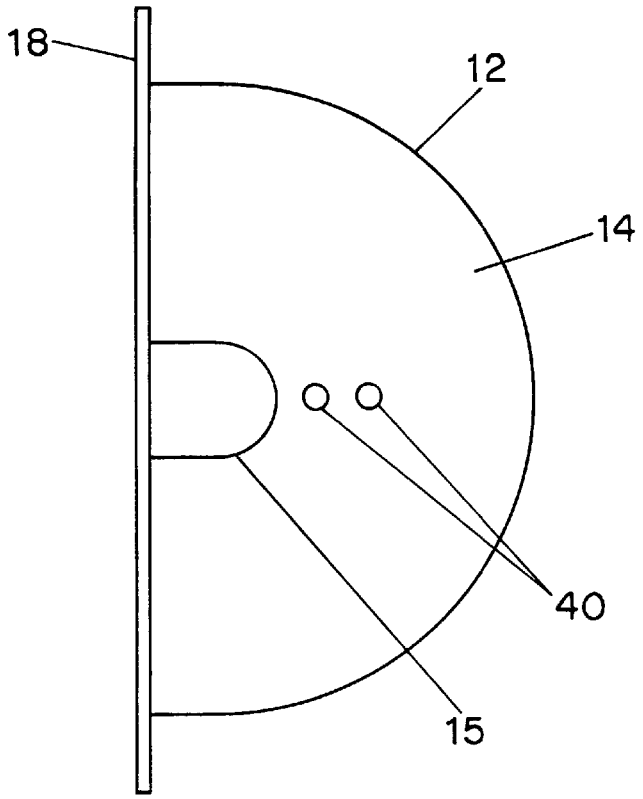
FIG. 3 is a side view of the housing of the holder.

Turning now to FIG. 3, the exterior surface of the sidewall 14, with its cut-out 15, also carries a pair of spaced cylindrical studs 40 extending outwardly from the surface and spaced from one another along the common radii of rearwall 12 and cut-out 15. The studs engage the longitudinal slot 32 of slidable member 30 to constrain and limit its motion along a horizontal path.

Figure 2:
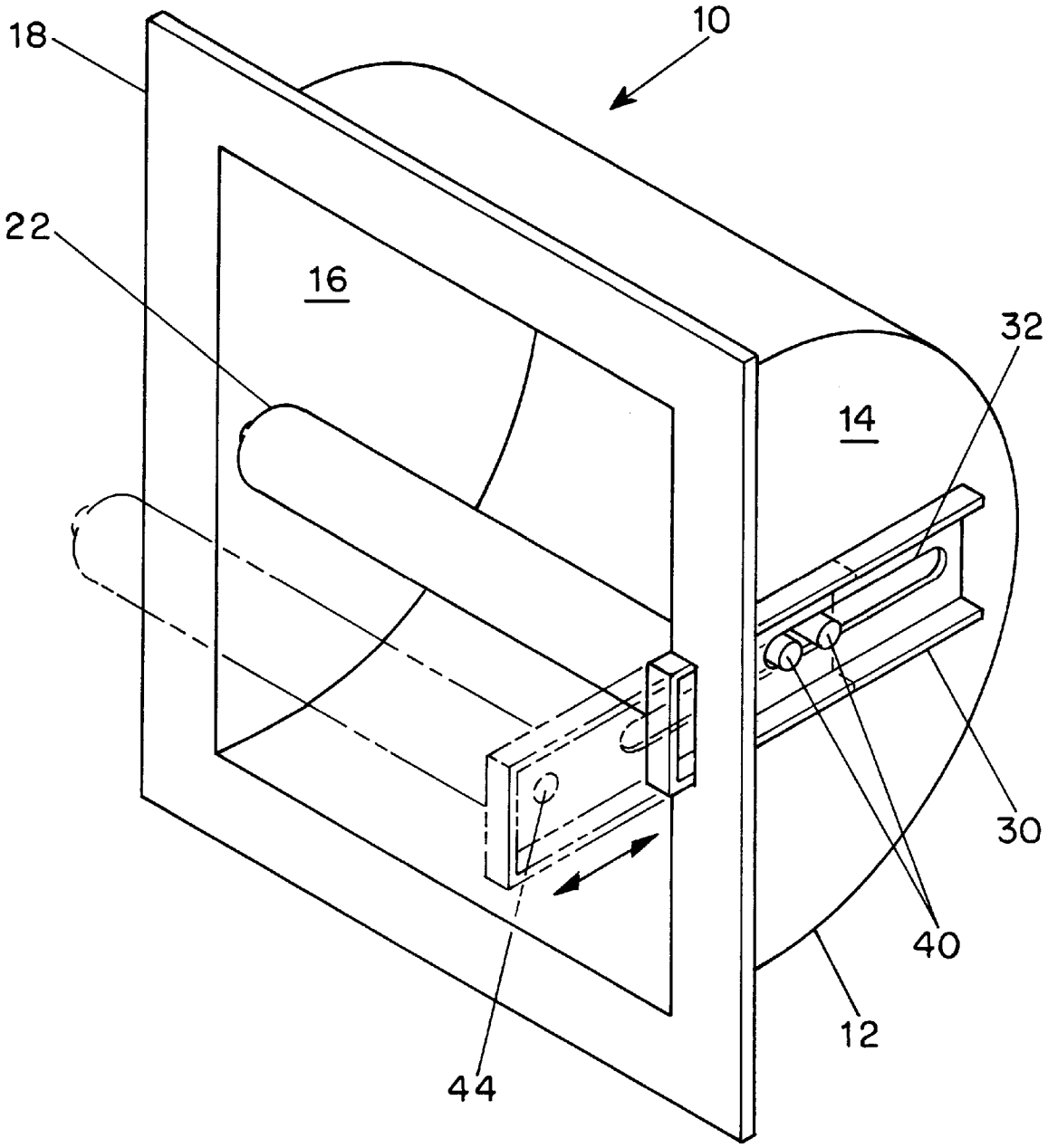
FIG. 2 is a perspective view of the assembled holder of the invention, illustrating the movement of the slidable member and spindle relative to the housing.

FIG. 2 illustrates the fully assembled holder, with slideable member 30 mounted on sidewall 14 with its slot 32 engaged by the studs 40. The solid line depiction shows the slideable member 30 and spindle 22 in fully retracted position to hold a tissue roll in normal position for use. To change a roll, the cardboard tube of the spent roll is simply grasped and pulled forward to the position shown in dotted line, as limited by the rearmost stud 40, exposing the free end of the spindle sufficiently forward of the housing to permit easy removal of the cardboard tube and insertion of the new roll of tissue. The new roll is then pushed rearwardly until the spindle is within the housing and the free end of the spindle engages a detent provided on the interior surface of sidewall 16. The detent retains the movable assembly within the housing with sufficient firmness to resist the normal forces encountered in pulling paper from the roll while at the same time, allowing the assembly to be released when a roll has to be changed.

Figure 4:
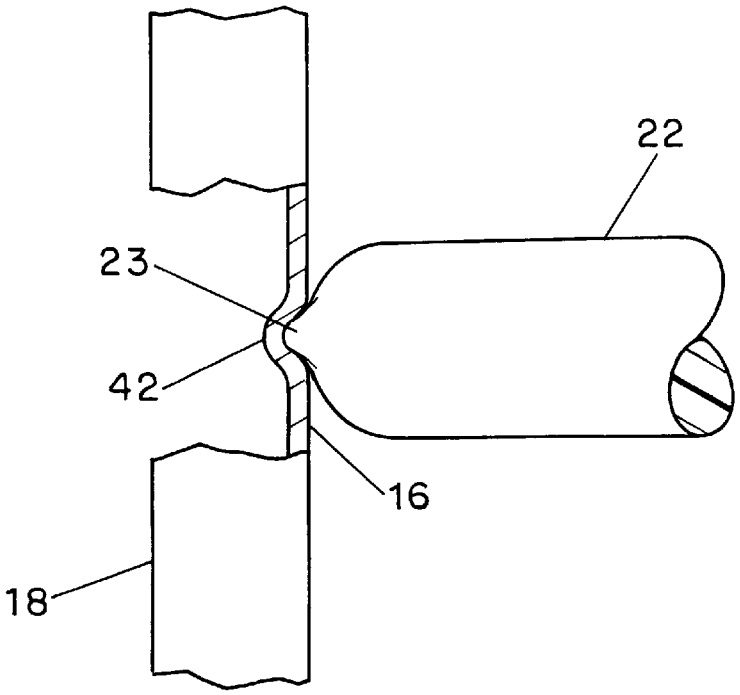
FIG. 4 is a partial sectional view of the left side of the housing, showing the detent means for retaining the spindle in the housing.

A suitable form of detent for this purpose is illustrated in FIG. 4. As shown, the sidewall 16 of the housing is formed with a depression, or dimple, 42, which is engaged by a mating protrusion 23 on the end of spindle 22. Alternatively, the dimple may be formed in the end of spindle 22 and a mating protrusion provided in the sidewall 16. It will be understood that the side walls of the housing, while substantially rigid, will have sufficient elasticity to permit the protrusion 23 to slide over the wall upon insertion into the housing until it engages the dimple 42. If such elasticity is not available, a conventional spring-biased ball detent may be provided in the end of the spindle to engage the dimple.

Turning back to FIG. 2, the slideable member 30 is conveniently formed as a shallow elongated channel with its forward end closed. The cross-section of the channel is generally rectangular and sized to move snugly through the cut-out 19 in flange 18. The longitudinal slot 32 extends over a portion of the length of member 30 to engage studs 40. After assembling the member 30 on the housing, the studs 40 may be peened over or otherwise capped to retain the member snugly against the sidewall 14 but with sufficient clearance to permit free sliding movement.

The length of slot 32 and the spacing of studs 40 are selected to permit withdrawal of spindle 22 sufficiently forward of the housing to permit easy insertion of a full roll of toilet tissue, while allowing the detent means on the spindle and sidewall 16 to engage. As indicated in dotted line by the numeral 44, the spindle 22 is secured at the forward end of member 30 by a screw or other suitable fastener.

The housing and slideable member may be fabricated from metal or plastic, or combinations thereof, as may be desired. The spindle may similarly be made of any suitable material, solid or hollow, with provision made for the detent means at the free end and for securing the other end to the slideable member.

Although the preferred embodiment shown is adapted for recessed mounting in a suitably sized opening in a wall, it will be appreciated that the housing may be adapted for flush mounting on a surface, such as by making the housing rectangular rather than semi-cylindrical in shape and providing suitable openings for fasteners. It will also be apparent that the invention may be adapted to hold rolls of sheet material other than toilet tissue, such as paper towels, aluminum or plastic wrap, etc., without departing from the scope of the invention.

It will be understood that other variations and modifications will occur to those skilled in the art and the invention is limited only as set forth in the appended claims.

I claim:

1. A holder for a roll of toilet tissue or the like comprising a housing for receiving at least partially, a roll of toilet tissue, a spindle for rotatably supporting said roll, and a member slidably mounted on said housing and secured at one end to one end of said spindle, the other end of said spindle being free, said member being movable between a first position in which a tissue roll supported on said spindle is partially received within said housing and a second position outward of said housing to enable a tissue roll to be inserted over the free end of said spindle.

2. The holder of claim 1, wherein said housing is adapted to be mounted in a recess in a wall.

3. The holder of claim 1 further comprising a detent cooperating with said spindle releaseably retaining said member and spindle in said first position.

4. The holder of claim 3 wherein said detent comprises recess formed in one of said wall of said housing and the free end of said spindle, and a protrusion formed on the other of the wall of said housing and the free end of said spindle, said protrusion being shaped to be received in said recess.

5. The holder of claim 1 wherein said housing comprises a pair of planar side walls, a semi-cylindrical rear wall between said side walls, the front edges of said side and rear walls forming a rectangular opening, and a flange surrounding said rectangular opening, the inner surfaces of said side and rear walls providing a substantially semi-cylindrical chamber to receive said roll, said member being slidably mounted on the outer surface of one of said side walls.

6. The holder of claim 5 wherein said member has a generally flat elongated rectangular shape, and includes a longitudinal slot extending over part of its length, and wherein a side wall of said housing includes a pair of spaced-apart cylindrical studs extending from the exterior surface thereof for engagement with said longitudinal slot to limit movement of said member.

7. The holder of claim 6 further comprising an opening in said flange to permit extension of one end of said member outwardly of said housing.

8. The holder of claim 7 wherein said spindle is fixed at one end to said one end of said member.

* * * * *